US005241742A

United States Patent [19]

Sawada

[11] Patent Number: 5,241,742

[45] Date of Patent: Sep. 7, 1993

[54] APPARATUS FOR APPLYING BOTTOM END STOPS AND SLIDERS TO A SLIDE FASTENER STRINGER CHAIN

[75] Inventor: Toshiaki Sawada, Toyama, Japan

[73] Assignee: Yoshida Kogyo K. K., Tokyo, Japan

[21] Appl. No.: 905,386

[22] Filed: Jun. 29, 1992

[30] Foreign Application Priority Data

Jun. 29, 1991 [JP] Japan ..... 3-256053

[51] Int. Cl.[5] ..... A41H 37/06

[52] U.S. Cl. ..... 29/767; 29/408; 29/768; 221/173

[58] Field of Search ..... 29/767, 768, 408, 33.2; 221/173

[56] References Cited

U.S. PATENT DOCUMENTS 4,337,877 7/1982 Doori ..... 221/171
4,355,461 10/1982 Doori ..... 29/768
4,747,210 5/1988 Suzuki ..... 29/768
4,771,522 9/1988 Osaki ..... 29/33.2
4,974,315 12/1990 Yunoki ..... 29/768

FOREIGN PATENT DOCUMENTS 44-12543 6/1969 Japan .

*Primary Examiner*—P. W. Echols
*Attorney, Agent, or Firm*—Hill, Steadman & Simpson

[57] ABSTRACT

An apparatus for assembling a continuous chain of fastener stringers with bottom end stops and sliders comprises a slider holder means capable of rotating about an axis extending parallel to the direction of feed of the stringer chain and having symmetrical upper and lower portions each with an identical set of operative parts. The slider holder means is rotatable intermittently each for an angular distance of 180° between a first position in which a slider is received into one of a pair of pockets formed at opposite ends of the slider holder and a second position in which another slider already in the other pocket is assembled with its pull tab disposed on the same side of the stringer chain on which a bottom end stop is assembled.

3 Claims, 2 Drawing Sheets

APPARATUS FOR APPLYING BOTTOM END STOPS AND SLIDERS TO A SLIDE FASTENER STRINGER CHAIN

BACKGROUND OF THE INVENTION

1. Field of the Invention

This invention relates to an apparatus for applying bottom end stops and sliders to a slide fastener stringer chain.

2. Prior Art

Various apparatus arrangements have been proposed for assembling slide fastener components parts such as bottom end stops, sliders, top end stops and the like. Japanese Patent Publication No. 44-12543 discloses an apparatus arranged such that a bottom end stop is applied from below to the back side of a stringer chain and a slider and top end stops are subsequently applied to the front side of the chain, in which instance a parts holder carrying sliders is moved along an arcuate path into a horizontal line of movement of the stringer chain. This prior apparatus has the advantage that the slider is mounted in place with its pull tab disposed on the same side of the stringer chain as the bottom end stop is applied, thus making a slide fastener finished sightly. However, it has a drawback in that the respective units for applying bottom end stops and sliders are located relatively apart from each other, requiring increased floor space and further in that the slider applying unit moves arcuately each time as it feeds and applies sliders one at a time, thus leading to inefficient operation of the apparatus.

Japanese Laid-Open Patent Publication No. 63-111805 discloses an apparatus including a bottom end stop applying unit and a slider applying unit located respectively above and below the path of feed of a stringer chain such that a bottom end stop is applied to the front side of the chain while a slider is mounted with its pull tab hung down on the reverse side of the chain. With such an apparatus, the resulting slide fastener product appears unsightly as the pull tab of the slider is not on the same side of the stringer chain as is the bottom end stop, and the operation of finishing the stringer chain is also time-consuming as the slider holder makes reciprocating movement similar to the first-mentioned prior art.

SUMMARY OF THE INVENTION

With the foregoing drawbacks of the prior art in view, the present invention seeks to provide an apparatus for applying bottom end stops and sliders to a continuous chain of fastener stringers which is capable of operation at an increased rate of efficiency and which is arranged to apply a slider with its pull tab disposed on the same side of the stringer chain on which a bottom end stop is mounted.

The above and other objects and features of the invention will become manifest to those versed in the art upon making reference to the following detailed description taken in conjunction with the accompanying drawings.

According to the invention, there is provided an apparatus for applying bottom end stops and sliders having pull tabs onto a slide fastener stringer chain which comprises a bottom end stop applying means for applying bottom end stops onto the stringer chain and a slider holder having at opposite ends thereof a pair of pockets, a pair of clampers pivotably connected to the slider holder, a pair of retainer arms pivotably connected to the slider holder, the clampers and the retainer arms cooperating in releasably holding sliders in the respective pockets, and a rotating means connected to the center of the slider holder and rotating the latter intermittently each for an angular distance of 180° whereby the slider holder flips alternately between a first position in which one of the pockets is posed to receive and retain one slider and a second position in which the other pocket is posed to transfer another slider therein for application onto the stringer chain.

DETAILED DESCRIPTION OF THE INVENTION

Figure 1:
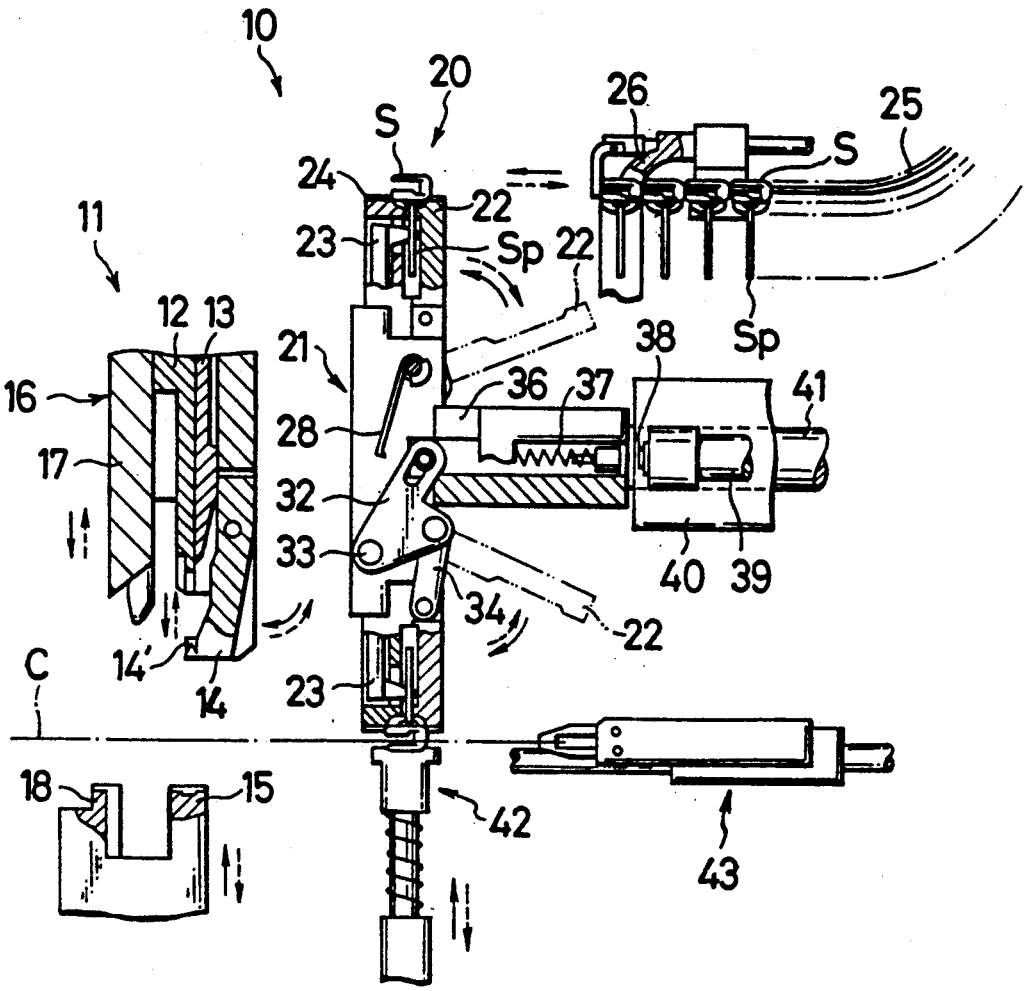
FIG. 1 is a fragmentary side elevational view, partially in cross section, of an apparatus embodying the invention.
Figure 3:
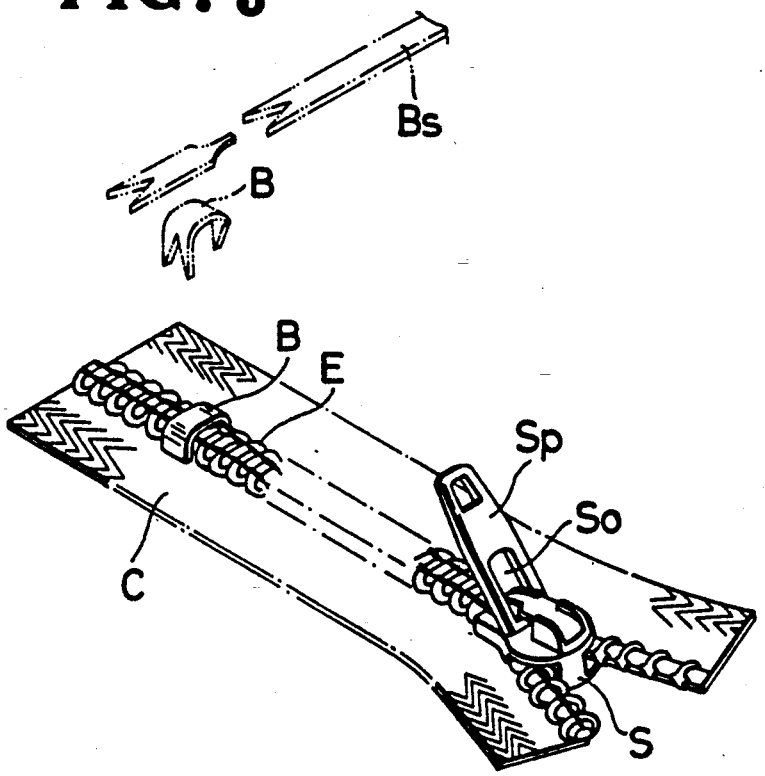
FIG. 3 is a segmentary perspective view of a slide fastener finished according to the invention.

Referring to the drawings and firstly FIG. 1, there is shown a general layout in elevation of an apparatus 10 embodying the invention for applying bottom end stops B (FIG. 3) and sliders S onto a continuous chain of fastener stringers C. The apparatus 10 comprises a bottom end stop applying unit 11 consisting of a forming punch 12, a cutting punch 13, a bender 14 and a forming die 15. An elongate metal strip Bs (FIG. 3) is fed into a pocket 14' formed in the bender 14 and cut to a predetermined length by the cutting punch 13. The strip thus cut is forced down by the forming punch 12 against the forming die 15 and thereby clamped into place on the front side of the stringer chain C over fastener coupling elements E as shown in FIG. 3. Alternatively, preformed bottom end stops may be supplied successively from a feed chute (not shown) to the bottom end stop applying unit 11. Further alternatively, if the coupling elements E are made of a plastic material there may be used end stops of a similar plastic material which may be fused by ultrasonic processing in place together with the coupling elements E on the stringer chain C.

Designated at 16 is a cutting unit which comprises a cutter punch 17 and a cutter die 18 which are vertically movable toward and away from each other at a position upstream of the bottom end stop applying unit 11. The cutting unit 16 is actuated upon assembly of the end stop B and the slider S to sever the stringer chain C to a product length. This cutting unit may be precluded with the type of stringer chain C having space portions at predetermined intervals, in which instance the bottom end stop B and the slider S are mounted on each of the stringer chain segments carrying a length of coupling elements E intermediate between adjacent space portions of the stringer chain C which is subsequently advanced by a pair of intermittently rotatable rollers.

Now, turning to a slider holder unit 20 which constitutes an important aspect of the invention, it will be appreciated that the holder unit 20 is constructed such that it can rotate about a central axis extending parallel to the direction of feed of the stringer chain C. More specifically, the slider holder unit 20 is controlled to rotate in either direction for an angular distance of 180° during each cycle of operation in which the unit 20 receives a supply of sliders S one at a time at one of its ends and substantially simultaneously transfers another slider S at the other end onto the stringer chain C.

The slider holder unit 20 comprises a slider holder 21 having symmetrical upper and lower halves each provided with a retainer arm 22 and a clamper 23 both pivotably connected at their respective one ends to the holder body. Since its upper and lower halves are symmetrically structured, it suffices to describe the slider holder 21 only in connection with one of such halves.

The slider holder 21 has a pocket 24 formed in each of its upper and lower end surfaces and dimensioned to receive and retain therein one slider S at a time. A multiplicity of sliders S are supplied from a hopper (not shown) through a feed chute 25 and advanced successively therealong under their own gravity with their pull tabs Sp hung down as shown in FIG. 1. A leading one of sliders S is captured and fed by a pusher means 26 into the pocket 24 of the slider holder 21 while the retainer arm 22 is flipped down away from the holder 21. The retainer arm 22 is connected at one end pivotably about a pin 27 to the slider holder 21 and normally biased counterclockwise by a spring 28 to urge the other end toward the pocket 24.

The clamper 23 is connected at one end pivotably about a pin 29 and normally biased clockwise by a compression spring 30 to urge a locking projection 31 at the other end into an opening So (FIG. 3) of the slider S received in the pocket 24. Thus, the clamper 23 cooperates with the retainer arm 22 in releasably holding the slider S in the pocket 24 firmly in proper position.

Designated at 32 is a first link generally triangular in shape having its apex portion pivotably connected by a pin 33 to the slider holder 21. A second link 34 is movably connected between the first link 32 and the retainer arm 22 and adapted to displace the retainer arm 22 away out of engagement with the pocket 24 in a manner later described. The first link 32 has an elongate slot 35 formed therein at a position remote from the pin 33 for movably receiving a slide member 36 connected via compression spring 37 to a piston 38 of a fluid-operated cylinder 39 mounted on a support block 40.

Figure 2:
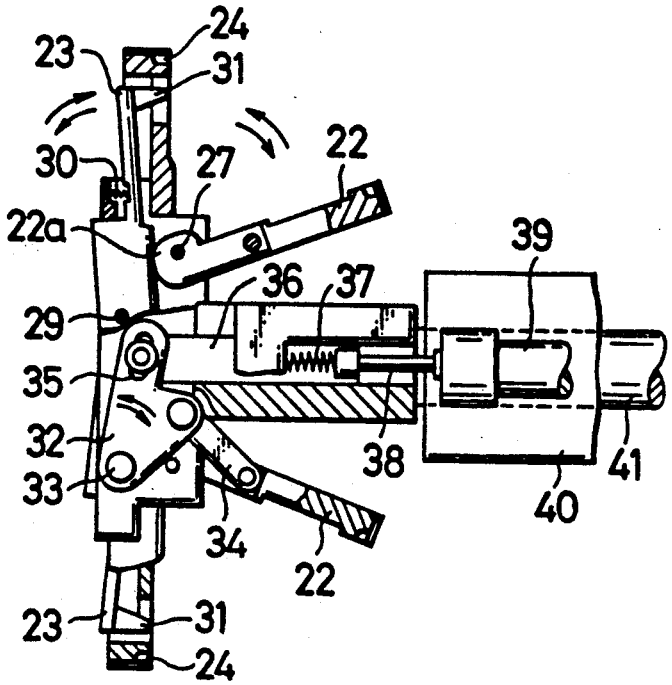
FIG. 2 is a side elevational, partly sectional view of a portion of the apparatus of FIG. 1.

A forward stroke of the piston 38 toward the left as viewed in the drawings causes the slide member 36 to accordingly move horizontally in the direction of the slider holder 21, urging the first link 32 to rotate counter-clockwise and the second link 34 to move upwardly so that the retainer arm 22 is urged to rotate clockwise away from the slider holder 21 against the tension of the spring 28. In this position indicated by dotted line in FIG. 1 and by solid line in FIG. 2, the retainer arm 22 has its cam portion **22*a* adjacent the pin 27 brought into abutting engagement with the clamper 23 as shown in FIG. 2, whereupon the clamper 23 is urged against the tension of the spring 30 to rotate slightly counter-clockwise with its locking projection 31 fully disengaged from the slider pull tab Sp, thus restoring the initial position of the slider holder 21 ready for receiving the next one of sliders S from the chute 25**.

Though not shown in the drawings, the fluid-operated cylinder 39 is provided in a pair on opposite sides of the support block 40 for actuating the respective link mechanism 32, 34. The two cylinders 39 are controlled to operate in timed relation such that reception of one slider S from the chute 25 into the pocket 24 at the upper end position of the slider holder 21 takes place substantially simultaneously with threading through the stringer chain C of another slider S already in the pocket 24 at the lower end position of the slider holder 21.

Modifications may be made as obvious to those skilled in the art such that both of the retainer arms 22 can be actuated by a single fluid-operated cylinder 39 for their respective departing movement from the slider holder 21.

Designated at 41 is a rotary shaft on which the slider holder 21 is centrally mounted and which is driven by a suitable actuator such as for example a rack-and-pinion drive (not shown). The rotary shaft 41 is rotated intermittently each for an angular distance of 180° so that the slider holder 21 flips alternately between the upper (first) position in which one slider S is received and retained in one pocket 24 and the lower (second) position in which another slider S previously received in the other pocket 24 is threaded through the stringer chain C. This cycle of alternate slider feeding and application is repeated automatically.

Designated at 42 is a support anvil positioned in vertically confronting relation to the slider holder 21 and adapted to cooperate therewith in holding the slider S securely in place during its threading through the stringer chain C.

Upon application of the slider S onto the stringer chain C, the retainer arm 22 is lifted apart from the slider holder 21 to leave the slider S with its pull tab Sp disposed on the front side of the stringer chain C on which the bottom end stop B has been previously mounted as shown in FIG. 3. The stringer chain C is advanced by means of a gripper unit 43 in a manner well known in the art.

Obviously, various modifications and variations of the present invention are possible in the light of the above teaching. It is therefore to be understood that within the scope of the appended claims the invention may be practiced otherwise than as specifically described.

What is claimed is:

1. An apparatus for applying bottom end stops and sliders having pull tabs onto a slide fastener stringer chain which comprises a bottom end stop applying means for applying bottom end stops onto the stringer chain and a slider holder having at opposite ends thereof a pair of pockets, a pair of clampers pivotably connected to said slider holder, a pair of retainer arms pivotably connected to said slider holder, said clampers and said retainer arms cooperating in releasably holding sliders in the respective pockets, and an rotating means connected to the center of said slider holder and rotating the latter intermittently each for an angular distance of 180° whereby said slider holder flips alternately between a first position in which one of said pockets is posed to receive and retain one slider and a second position in which the other pocket is posed to transfer another slider therein for application onto said stringer chain.

2. An apparatus according to claim 1 which further includes links connected to said retainer arms and an actuating means adapted to move said links pivotally to displace said retainer arms apart from said pockets.

3. An apparatus according to claim 1 wherein said slider holder is rotatable into said first position for receiving one slider at a time with its pull tab hung down so that said one slider is applied at said second position with its pull tab disposed on the same side of said stringer chain on which said bottom end stop is applied.

* * * * *